US008157219B2

(12) United States Patent
Ashraf et al.

(10) Patent No.: US 8,157,219 B2
(45) Date of Patent: Apr. 17, 2012

(54) VEHICLE DETECTION SYSTEM

(75) Inventors: Ahtasham Ashraf, Madison, WI (US); David Baldwin, Madison, WI (US)

(73) Assignee: Central Signal, LLC, Madison, WI (US)

( * ) Notice: Subject to any disclaimer, the term of this patent is extended or adjusted under 35 U.S.C. 154(b) by 461 days.

(21) Appl. No.: 12/014,630

(22) Filed: Jan. 15, 2008

(65) Prior Publication Data

US 2008/0169385 A1 Jul. 17, 2008

Related U.S. Application Data

(60) Provisional application No. 60/884,930, filed on Jan. 15, 2007.

(51) Int. Cl.
*B61L 1/02* (2006.01)

(52) U.S. Cl. ..... 246/130; 246/204; 246/247

(58) Field of Classification Search ..... 246/111, 246/130, 122 R, 202, 208, 249, 247, 360, 246/473.1, 293, 292, 220, 125, 126
See application file for complete search history.

(56) References Cited

U.S. PATENT DOCUMENTS

| | | | | |
|---|---|---|---|---|
| 847,105 | A | 3/1907 | Parrish, Jr. | |
| 2,664,499 | A | 12/1953 | Muse | |
| 3,810,119 | A | 5/1974 | Zieve et al. | |
| 3,816,796 | A | 6/1974 | Molloy et al. | |
| 3,974,991 | A | 8/1976 | Geiger | |
| 4,103,303 | A | 7/1978 | Regenos et al. | |
| 4,196,412 | A | 4/1980 | Sluis et al. | |
| 4,250,483 | A | 2/1981 | Rubner | |
| 4,251,041 | A | 2/1981 | Svet | |
| 4,307,860 | A * | 12/1981 | Kuhn | 246/128 |
| 4,324,376 | A * | 4/1982 | Kuhn | 246/125 |
| 4,361,301 | A * | 11/1982 | Rush | 246/34 R |
| 4,365,777 | A * | 12/1982 | Geiger | 246/130 |
| 4,449,115 | A | 5/1984 | Koerner | |
| 4,581,700 | A * | 4/1986 | Farnham et al. | 700/80 |
| 4,703,303 | A | 10/1987 | Snee | |
| 4,711,418 | A | 12/1987 | Aver et al. | |
| 4,727,372 | A | 2/1988 | Buttemer | |
| 4,787,581 | A * | 11/1988 | Dobler et al. | 246/247 |
| 4,906,979 | A * | 3/1990 | Kimura | 340/658 |
| 4,934,633 | A * | 6/1990 | Ballinger et al. | 246/473.1 |
| 5,006,847 | A | 4/1991 | Rush et al. | |

(Continued)

FOREIGN PATENT DOCUMENTS

DE 195 32 640 A1 2/1997

(Continued)

OTHER PUBLICATIONS

Caruso, M. et al, "Vehicle Detection and Compass Applications using AMR Magnetic Sensors," 13 pgs, www.ssec.honeywell.com.

(Continued)

*Primary Examiner* — S. Joseph Morano
*Assistant Examiner* — Jason C Smith
(74) *Attorney, Agent, or Firm* — Sylke Law Offices, LLC; C. Thomas Sylke

(57) ABSTRACT

An vehicle detection system is provided for tracking, detecting, and monitoring vehicles. The system and methods of the present invention are suitable for on track and roadway vehicles. In particular the present invention provides an improved and cost effective system and methods for tracking, detecting and monitoring locomotives and on track vehicles.

21 Claims, 6 Drawing Sheets

U.S. PATENT DOCUMENTS

| | | | | |
|---|---|---|---|---|
| 5,050,823 | A | 9/1991 | Parker | |
| 5,098,044 | A | 3/1992 | Petit et al. | |
| 5,153,525 | A | 10/1992 | Hoekman et al. | |
| 5,278,555 | A | 1/1994 | Hoekman | |
| 5,281,965 | A | 1/1994 | Hoekman et al. | |
| 5,361,064 | A | 11/1994 | Hamer et al. | |
| 5,417,388 | A | 5/1995 | Stillwell | |
| 5,437,422 | A | 8/1995 | Newman | |
| 5,491,475 | A | 2/1996 | Rouse et al. | |
| 5,504,860 | A * | 4/1996 | George et al. | 714/11 |
| 5,508,698 | A | 4/1996 | Hoekman | |
| 5,590,855 | A | 1/1997 | Kato et al. | |
| 5,620,155 | A | 4/1997 | Michalek | |
| 5,734,338 | A | 3/1998 | Hoekman et al. | |
| 5,737,173 | A | 4/1998 | Ross et al. | |
| 5,751,225 | A | 5/1998 | Fedde et al. | |
| 5,850,192 | A | 12/1998 | Turk et al. | |
| 5,868,360 | A | 2/1999 | Bader et al. | |
| 5,924,652 | A * | 7/1999 | Ballinger | 246/126 |
| 5,954,299 | A * | 9/1999 | Pace | 246/293 |
| 6,232,887 | B1 * | 5/2001 | Carson | 340/903 |
| 6,241,197 | B1 | 6/2001 | Harland | |
| 6,290,187 | B1 * | 9/2001 | Egami | 246/122 R |
| 6,292,112 | B1 * | 9/2001 | Bader et al. | 340/941 |
| 6,342,845 | B1 | 1/2002 | Hilliard et al. | |
| 6,386,486 | B1 | 5/2002 | Speranza | |
| 6,457,682 | B2 * | 10/2002 | Anderson et al. | 246/292 |
| 6,519,512 | B1 | 2/2003 | Haas et al. | |
| 6,604,031 | B2 | 8/2003 | Oguma et al. | |
| 6,641,091 | B1 | 11/2003 | Hilleary | |
| 6,683,540 | B1 | 1/2004 | Harrison | |
| 6,688,561 | B2 * | 2/2004 | Mollet et al. | 246/473.1 |
| 6,799,097 | B2 | 9/2004 | Antelo et al. | |
| 6,828,920 | B2 | 12/2004 | Owen et al. | |
| 6,828,956 | B2 | 12/2004 | Notagashira | |
| 6,829,526 | B2 * | 12/2004 | Oguma et al. | 701/19 |
| 7,075,427 | B1 * | 7/2006 | Pace et al. | 340/539.22 |
| 7,254,467 | B2 * | 8/2007 | Fries et al. | 701/19 |
| 7,296,770 | B2 | 11/2007 | Franke | |
| 7,575,202 | B2 * | 8/2009 | Sharkey et al. | 246/293 |
| 7,577,502 | B1 | 8/2009 | Henry et al. | |
| 2001/0022332 | A1 * | 9/2001 | Harland | 246/122 R |
| 2002/0049520 | A1 * | 4/2002 | Mays | 701/19 |
| 2002/0177942 | A1 | 11/2002 | Knaian et al. | |
| 2002/0185571 | A1 * | 12/2002 | Bryant et al. | 246/125 |
| 2004/0088923 | A1 | 5/2004 | Burke | |
| 2004/0119587 | A1 | 6/2004 | Davenport et al. | |
| 2004/0130463 | A1 | 7/2004 | Bloomquist et al. | |
| 2004/0181321 | A1 | 9/2004 | Fries et al. | |
| 2004/0201486 | A1 | 10/2004 | Knowles et al. | |
| 2004/0249571 | A1 | 12/2004 | Blesener et al. | |
| 2004/0261533 | A1 | 12/2004 | Davenport et al. | |
| 2005/0194497 | A1 | 9/2005 | Matzan | |
| 2005/0237215 | A1 | 10/2005 | Hatfield et al. | |
| 2005/0284987 | A1 | 12/2005 | Kande et al. | |
| 2006/0272539 | A1 | 12/2006 | Clavel | |
| 2007/0129858 | A1 | 6/2007 | Herzog et al. | |
| 2007/0146152 | A1 | 6/2007 | Welles et al. | |
| 2007/0276600 | A1 | 11/2007 | King et al. | |
| 2008/0169385 | A1 * | 7/2008 | Ashraf et al. | 246/130 |
| 2008/0183306 | A1 | 7/2008 | Ashraf et al. | |
| 2009/0326746 | A1 | 12/2009 | Mian | |
| 2010/0108823 | A1 * | 5/2010 | Barnes | 246/111 |

FOREIGN PATENT DOCUMENTS

| | | | |
|---|---|---|---|
| DE | 10 2004 035 901 | A1 | 3/2006 |
| DE | 20 2005 020 802 | U1 | 3/2007 |
| EP | 1 832 849 | A2 | 9/2007 |
| JP | 4321467 | | 11/1992 |
| JP | 10006994 | | 1/1998 |
| JP | 2003002207 | | 1/2003 |
| KR | 10-0688090 | B1 | 3/2007 |
| WO | 9725235 | | 7/1997 |
| WO | WO 2006/051355 | A1 | 5/2006 |
| WO | 2008080169 | | 7/2008 |
| WO | 2008080175 | | 7/2008 |

OTHER PUBLICATIONS

Chandra, V., "A Fail-Safe Interlocking System for Railways" (abstract), Design & Test of Computers, 8(1):58-66, Jan./Mar. 1991.

Honeywell, "Application Note—AN218—Vehicle Detection Using AMR Sensors," www.honeywell.com, 10 pgs, Aug. 2005.

Honeywell, "1-and 2-Axis Magnetic Sensors," HMC10001/1002; HMC1021/1022, pp. 1-15, Apr. 2000.

Honeywell, "Smart Digital Magnetometer," www.magneticsensors.com, 12 pgs, 900139 02-04 Rev. H.

3M, "Canoga Vehicle Detection System: A matched component system for vehicle counting," 3M Intelligent Transportation Systems, 2 pgs., 1998.

3M, "Canoga Vehicle Detection System, Advanced Traffic Products, Inc.,: The solution beneath the surface," 4 pgs., obtained from Internet at http://www.advancedtraffic.com/3mcanoga-pl.htm. Sep. 27, 2005.

3M, "Canoga Vehicle Detection System, Non-invasive Microloop Model 702," 3M Intelligent Transportation Systems, 4 pgs., 1997.

3M, Canoga Vehicle Detection Systems, list of products, obtained from Internet at http://products3.3m.com/catalog/us/en001/safety/traffic_control/node_GSTYGYSDV5be/..., Sep. 27, 2005.

3M, Canoga Vehicle Detection System: C800 Interface and Data Acquisition Software (C800 IS), C800 Vehicle Detectors, (product features), 3M Intelligent Transportation Systems, 7 pgs, date unknown.

Safety Now, "Allen-Bradley 6556 Micrologix Clutch/Brake Controller for Mechanical Stamping Presses," Apr. 2001, 4 pgs, www.ab.com/safety/safety_now/april01, obtained from website May 25, 2006.

Safety Now, "Back to School," article by Frank Watkins and Steve Dukich, www.ab.com/safety/safety_now/april01/back_school, 3 pgs, obtained from website May 25, 2006.

Trafinfo Communications, Inc., "Trafmate 6: Wireless Telemetry for Traffice Monitoring," 2 pgs., date unknown.

Wheatstone Bridge, www.geocities.com/CapeCanaveral/8341/bridge.htm?20061, 1 pg, obtained from website May 1, 2006.

Wheatstone Bridge, http://en.wikipedia.org/wiki/Wheatstone_bridge, 3 pgs, obtained from website May 1, 2006.

Wheatstone Bridge, "Measure an Unknown Resistance," www.dwiarda.com/scientific/Bridge.html, 1 pg, obtained from website May 1, 2006.

Notification of Transmittal of the International Search Report and the Written Opinion of the International Searching Authority for International Application No. PCT/US2007/088849 (1 pg).

International Search Report, International Application No. PCT/US2007/088849 (2 pgs).

Written Opinion of the International Searching Authority, International Application No. PCT/US2007/088849 (6 pgs).

Notification of Transmittal of the International Search Report and the Written Opinion of the International Searching Authority for International Application No. PCT/US2008/051099 (1 pg).

International Search Report, International Application No. PCT/US2008/051099 (3 pgs).

Written Opinion of the International Searching Authority, International Application No. PCT/US2008/051099 (5 pgs).

Extended European Patent Office Search Report, EPO Application No. 07 866 027.1 (10 pgs).

EPO Machine Translation of DE 195 32 640 Al (6 pages).

EPO Machine Translation of DE 10 2004 035 901 Al (5 pages).

Extended European Patent Office Search Report, EPO Application No. 08 727 699.4 (5 pgs).

Brawner, J., et al.; "Magnetometer Sensor Feasibility for Railroad and Highway Equipment Detection;" Innovations Deserving Exploratory Analysis Programs—High-Speed Rail IDEA Program; Transportation Research Board of the National Academies; Jun. 24, 2006, Publication Date Jun. 2008 (33 pgs).

Notification of Transmittal of the International Search Report and the Written Opinion of the International Searching Authority for International Application No. PCT/US2011/038481; KIPO mailing date Jan. 11, 2012 (2 pgs).

International Search Report, International Application No. PCT/US2011/038481; KIPO mailing date Jan. 11, 2012 (3 pgs).

Written Opinion of the International Searching Authority, International Application No. PCT/US2011/038481; KIPO mailing date Jan. 11, 2012 (5 pgs).
Notification of Transmittal of the International Search Report and the Written Opinion of the International Searching Authority for International Application No. PCT/US2011/038482; KIPO mailing date Jan. 13, 2012 (2 pgs).
International Search Report, International Application No. PCT/US2011/038482; KIPO mailing date Jan. 13, 2012 (3 pgs).
Written Opinion of the International Searching Authority, International Application No. PCT/US2011/038482; KIPO mailing date Jan. 13, 2012 (5 pgs).

* cited by examiner

VEHICLE DETECTION SYSTEM

CROSS REFERENCE TO RELATED APPLICATIONS

This application claims priority to: U.S. Non-provisional application Ser. No. 11/964,606, filed Dec. 26, 2007, now U.S. Pat. No. 8,028,961 B2, issued Oct. 4, 2011, PCT Application Serial Number PCT/US07/88849 filed Dec. 26, 2007, U.S. Provisional Application Ser. No. 60/884,930, filed Jan. 15, 2007, each application is fully incorporated by reference herein.

STATEMENT REGARDING FEDERALLY SPONSORED RESEARCH OR DEVELOPMENT

This invention was made with government support under USDA SBIR Phase 1 Contract No. 2006-33610-16783 and USDA SBIR Phase 2 Contract No. 2006-33610-18611 awarded by United States Department of Agriculture. The government has certain rights in the invention.

The present invention relates to systems for detecting and processing information generated by moving objects. More specifically various embodiments of the application relate to systems and methods for detecting and processing information generated by on-track vehicles including locomotives, train cars of all types and railroad maintenance and inspection vehicles.

BACKGROUND OF THE INVENTION

Methods for warning motor vehicle operators at highway-rail grade rail crossings are either passive or active. Passive warning methods at public crossings are often required by law to include the statutory crossbuck sign posted for each direction of traffic traversing the tracks. Alternative signs may be posted in addition to the crossbuck sign, such as number of tracks signs, "Do Not Stop on Tracks" signs, "Look for Trains" signs, statutory yield signs, statutory stop signs, and railroad crossing advance warning signs. The roadway surface can be painted with stop bars and railroad crossing symbols. Warning devices at private roadway crossings of railroad tracks can be provided by the roadway owner or the railroad and may be absent altogether or can be any combination of passive or active devices identical to those used at public crossings or of unique design. Active warning devices, by example, can be a warning bell, flashing red lights, swinging red lights, gate arms that obstruct roadway vehicle lanes, solid or flashing yellow advance warning lights in combination with statutory crossbuck signs, number of tracks signs, railroad advance warning signs, various informational signs, and pavement markings. Historically it has been cost prohibitive to include active warning systems at every grade crossing, thereby limiting many grade crossings to have merely passive warning systems.

Conventional railway systems often employ a method which uses track rails as part of a signal transmission path to detect the existence of a train within a defined length or configuration of track, commonly referred to as track circuits. The track rails within the track circuit are often an inherent element of the design of the circuit because they provide the current path necessary to discriminate the condition of the track circuit which is the basis of train detection.

A conventional track circuit is often based upon a series battery circuit. A battery, commonly referred to as a track battery, is often connected to one end of the track circuit and a relay, commonly referred to as a track relay, is connected to the other end of the track circuit. Current from the track battery flows through one rail of the track circuit, through the coil of the track relay and back to the track battery through the other rail of the track circuit. As long as all elements of this system are connected, the track relay will be energized. Typically, an energized track relay corresponds to the unoccupied state of the system in which a train is not present within the track circuit. In the event that a train does occupy the track circuit, the series track battery-track rails-track relay circuit becomes a parallel circuit in which the wheels and axles of the train provide a parallel path for current flow between the two track rails of the circuit. Most current flows in this new circuit path because its resistance is very low compared to the track relay resistance. As a result, the track relay cannot be energized if a train occupies the rails between the track battery and the track relay. A significant advantage of this system is that if the current path between the track battery and the track relay is opened, the track relay will not be energized. Common causes of track circuit failure with typical railroad fail-safe circuits that may interrupt the current path include broken rail, broken wire connections between the battery or relay and the rail, broken rail joint electrical bonds, and failed battery power. Should any element of the circuit fail, the signal control element, typically the track relay, will revert to the safest condition, which is de-energized. The typical track circuit is also an example of railroad signal closed circuit design. All elements of the circuit are necessary and only one current path is available to energize the track relay.

The track battery/relay circuit is often the basic functional unit for railroad signal system design. The energy state of track relays provides the fundamental input to the logical devices that control automatic signal systems, including wayside train signal, crossing signal, and interlocking operation.

Previously known methods for detecting trains that approach highway-rail grade crossings monitor and compare track circuit impedance to a known audio frequency signal. The signal is continuously monitored by the train detection unit which is tuned to an unoccupied track (normal state) during installation. Signal strength and phase within certain limits produce an energized output that corresponds to an unoccupied track circuit. When signal strength and/or phase are not within the normal state limits the train detection unit output corresponds to an occupied track circuit. A train occupying the track circuit changes the impedance of the circuit. The change vector for a moving train correlates to position of the leading or trailing wheels and axle of the train in the track circuit, train direction and speed.

The most advanced of such devices are capable of providing a "constant warning time" control for highway grade crossing signal operation. One of the advantages of this method at its most advanced application is the ability to cause crossing signals to operate for a predetermined time prior to the arrival of a train at a crossing roadway regardless of train speed. This device may provide multiple, independently programmable outputs which may be used control separate and independent systems. One output can be programmed to control the actual operation of the railroad crossing signal and the second output can be programmed to provide the appropriate input to a separate traffic light system that governs motor vehicle movement at an intersection near the railroad crossing.

In one aspect, a vehicle detection system detects roadway vehicles and an action is taken. Often the action taken is to adjust the frequency of intersection light operation in response to changing traffic patterns. It is common that roadway conditions can change dramatically as a result of a traffic accident, draw-bridge operation, or a train passing. As a result the rate of speed for the roadway vehicles is dramatically reduced, and often stopped. The slow rate of speed and common stoppage of traffic commonly is not accurately detected by certain magnetic field detectors.

In another aspect of vehicle detection systems trains are detected and active railroad signal crossing warning devices are activated to warn traffic at highway-rail grade crossings, and therefore advanced preemption of the warning devices is necessary. However, a major disadvantage to the use of known loop detectors is that they do not reliably detect slow-moving objects passing through the magnetic field. It is often the case that railroads require trains to stop for periods of time. Due to the size and mass of trains they do not have the ability to accelerate quickly from a stopped position. Therefore it is often the case that trains move at a slow rate of speed. One of the inherent problems associated with certain magnetic field detector is that a requisite minimum rate of speed prevents detection of slow moving objects.

It would be advantageous to have a vehicle detection system that is failsafe and detects the presence of trains whether stopped, or moving at any speed. It would be further advantageous to have such a system available at a reduced cost as compared to conventional systems.

Figure 1:
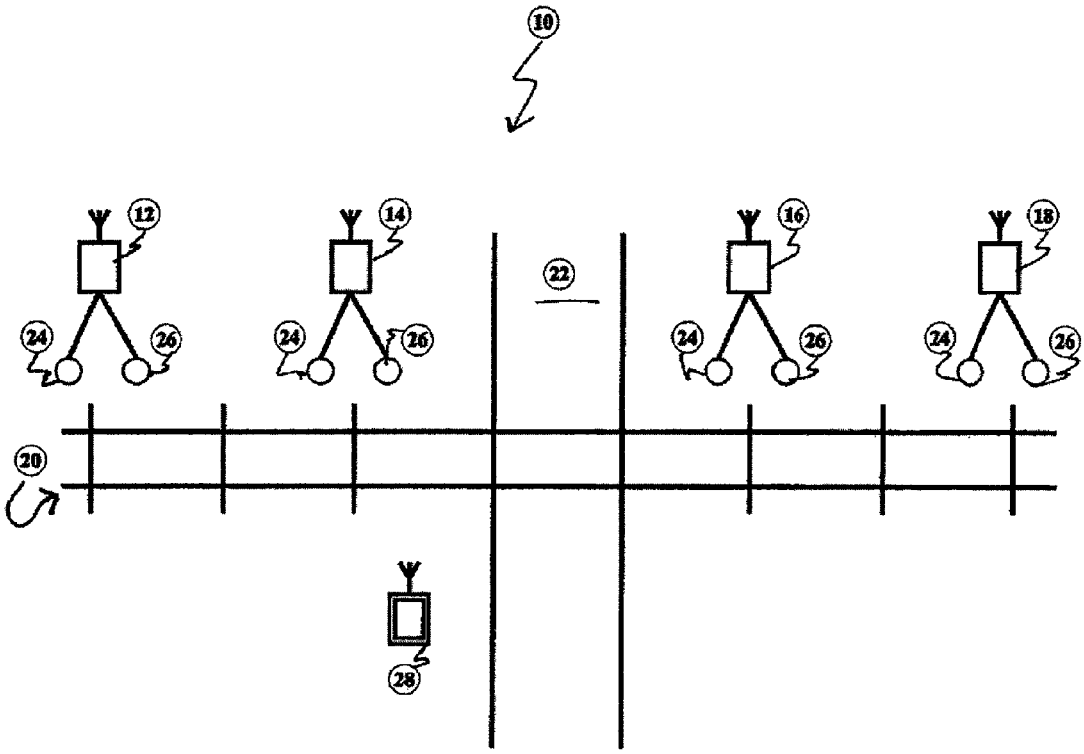
FIG. 1 is a conceptual schematic of the present invention for a highway-railroad grade warning device control system in accordance with at least one embodiment of the present invention.

Embodiments of the invention are described below with reference to the accompanying drawings, which are for illustrative purposes only. Throughout the views, reference numerals are used in the drawings, and the same reference numerals are used throughout several views and in the description to indicate same or like parts or steps.

DETAILED DESCRIPTION OF THE INVENTION

In the following detailed description, references are made to the accompanying drawings that form a part thereof, and are shown by way of illustrating specific embodiments in which the invention may be practiced. These embodiments are described in sufficient detail to enable those skilled in the art to practice the invention, and it is to be understood that other embodiments may be utilized and that structural, logical and electrical changes may be made without departing from the spirit and scope of the present invention.

An embodiment of a vehicle detection system 10 is represented in FIG. 1. The system 10 includes sensor devices 12, 14, 16, 18, each sensor 12, 14, 16, 18 has a pair of sensor nodes 24, 26, and a control processor 28. Each of the sensor nodes 24, 26 is placed in proximity to the railway track 20, which crosses a roadway 22. Data from the sensor nodes 24, 26 is communicated through wireless transmission and reception with the control processor 28. The wireless connection 28 can be chosen from a variety of wireless protocols, by example, 900 MHZ radio signals. The system 10 is not limited to a specific number of sensor nodes 24, 26. Sensor nodes need not be paired as in this embodiment, and devices 12, 14, 16, 18 can alternatively have more than 2 sensor nodes 24, 26.

Figure 2:
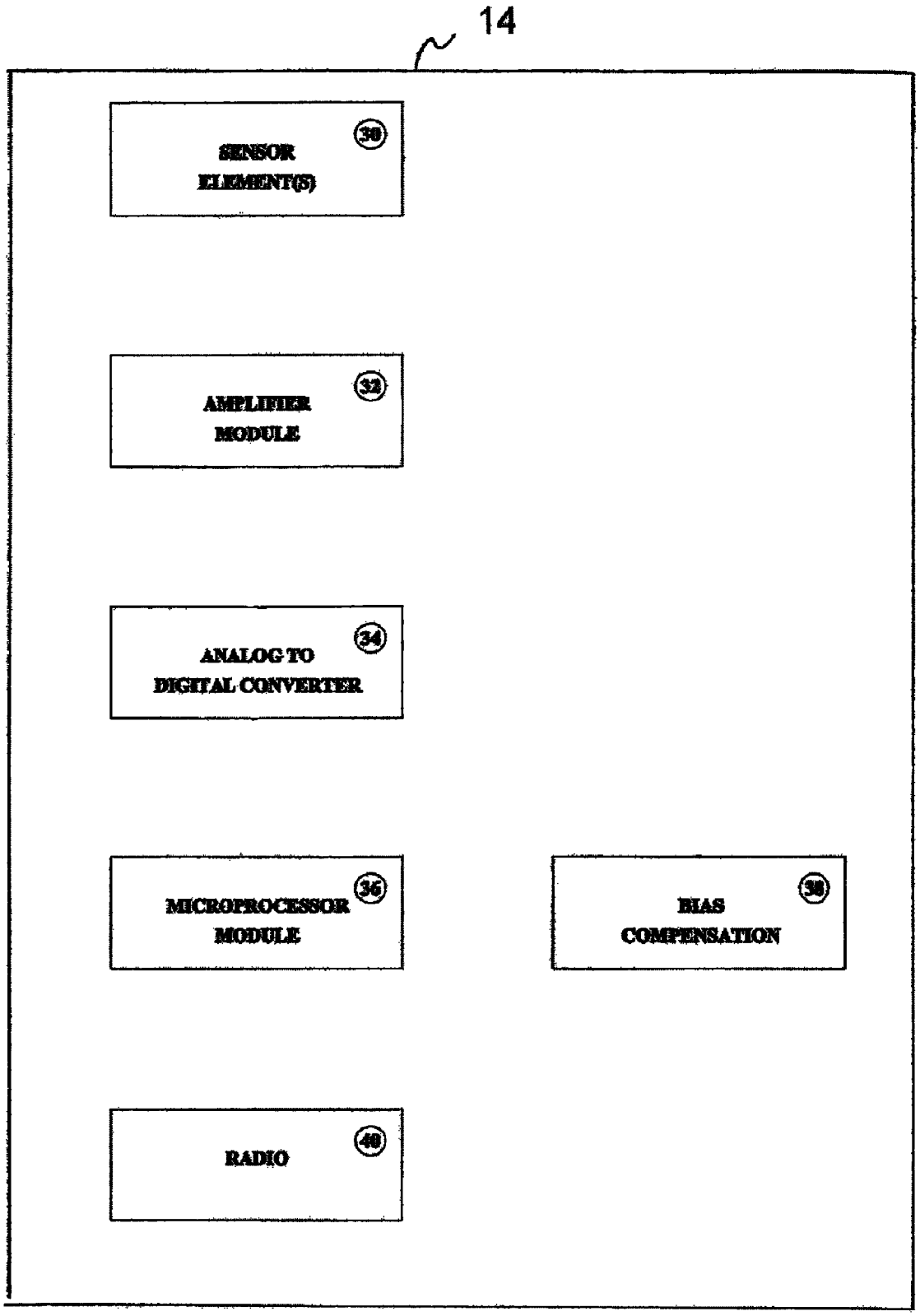
FIG. 2 is a block diagram of a sensor node in accordance with at least one embodiment of the present invention.

Referring now to FIG. 2, the sensor devices 12, 14, 16, 18 include one or multiple sensor elements 30, an amplifier module 32, and analog to digital converter 34, a microprocessor module 36, a bias compensation module 38 and a radio module 40. The sensor devices 12, 14, 16, 18 can be single or multi-dimensional One or more sensor nodes 24, 26 can be connected to the sensor device 12, 14, 16, 18. The sensor nodes 24, 26 receive data and transmit the data to the sensor devices 12, 14, 16, 18. The radio 40 sends data from the sensor device 12, 14, 16, 18 to the control processor 28. The microprocessor module 36 receives digital data from the analog to digital converter 34 and encodes the data in packets for transmission by the radio 40. The sensor element 30 provides a continuous signal to the amplifier module 32 which filters and amplifies the analog waveform for processing by the analog to digital converter 34. The microprocessor 36 also continuously receives data from the bias compensation module 38 and controls elements of a resistive network to maintain optimum bias for the sensor element 30. Data Conditioning enhances the signal to noise ratio of the sensor output by various filtering techniques such as Kalman, Infinite Impulse Response, and Finite Impulse Response filters. The Kalman filter is an advanced filtering technique that enhances the signal to noise ratio and eliminates unexpected signal variation. The filtered signal can also be amplified. Alternatively, the combination of sensor node 24, 26 and sensor device 12, 14, 16, 18 can be referred to as a sensor.

The sensor devices 12, 14, 16, 18 and control processor 28 can be placed at locations a significant distance from power lines, making it inconvenient for traditional power sources. A fuel cell system (not shown) can be connected to the paired sensors 12, 14, 16, 18 and control processor 28 to provide operating power. Alternatively, a photo voltaic system may be substituted for the fuel cell system. Alternatively, other sources of power can be used to provide power to the paired sensors 12, 14, 16, 18 and control processor 28.

Figure 3:
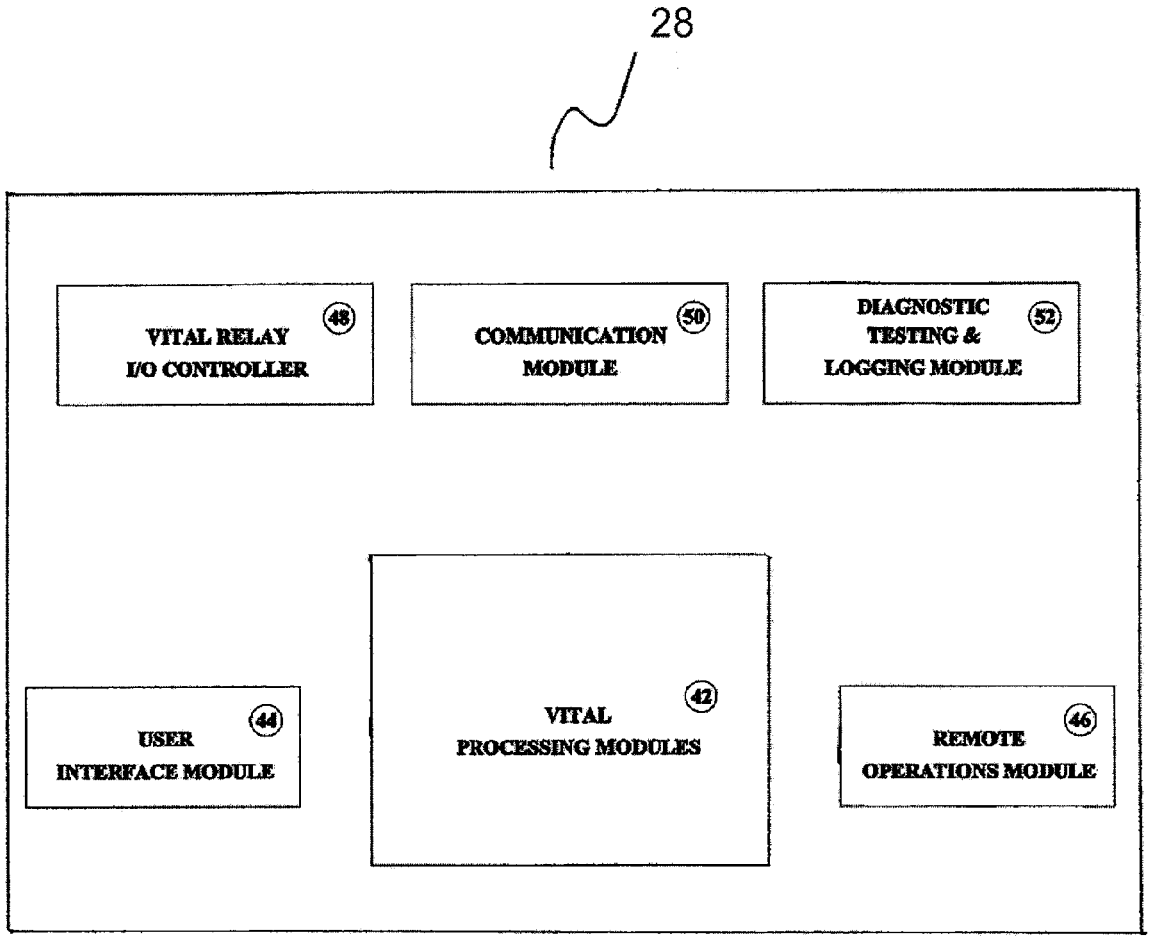
FIG. 3 is a block diagram of a control processor in accordance with at least one embodiment of the present invention.

Now referring to FIG. 3, the control processor 28 includes vital processing module 42, communication module 50, vital I/O modules 48, user interface module 44, diagnostic testing and data logging module 52, and remote operations module 46. The vital processing module 42 can be a central processing unit (CPU) that may be selected from a variety of suitable CPUs known in the art. Alternatively, module 42 can be two or more redundant CPUs. The communications module 50 receives data transmitted from the sensor devices 12, 14, 16, 18, exchanges data with VPU module 42, and with warning system peripheral devices (not shown). The vital I/O module 48 provides a vital interface control of conventional railroad signal relays or control devices that can be connected to the control processor 28. The diagnostic testing and data logging module 52 can provide a variety of user interface options, including, by example, RS232, USB, Ethernet, and wireless technologies, to facilitate user access to control processor 28 to enter site specific information, select appropriate user variable values, perform set-up and diagnostic testing and to review or download data log files. Data can be saved on dedicated hard drive, flash memory module, CD ROM drive or other devices appropriate to the intended environment. The user interface module 44, by example, can be a software module that provides configuration options, firmware update, device programming and debugging. The remote operations module 46 can provide the interfaces for remote communications with the system 10, using cellular or satellite channels. The module 46 can provide, for example, remote status checking, alarm notification, limited configuration and data transfer. The communication module 50, remote operations module 46 and user interface module 44 provide communications security and adaptability to a variety of communications protocols that can be executed by the system 10.

The sensor nodes 24, 26 are configured to respond to the presence of vehicles. The Earth's magnetic field is used as a magnetic background or "reference" point which stays substantially constant when the sensor nodes are installed in a fixed arrangement. Adjustments can be made in the event substantial constant magnetic offsetting, other than the Earth's magnetic field, occur near the sensor nodes 24, 26. Vehicles which are constructed of, or contain, hard and/or soft-iron materials affect the earth's magnetic flux. Hard-iron sources are materials that possess flux concentration abilities and can have remnant flux generation abilities. Soft-iron materials are often considered to be ferrous materials that concentrate magnetic flux into material and do not have any remnant flux generated within the material. Based upon relatively distinct hard and soft-iron composition of a vehicle the sensor element 30 will encounter a relatively small (in the range of milligauss) Earth field bias along with relatively large (in the range of 3-4 gauss) spikes as typical vehicles come into range of the sensing element. When vehicles are near the sensor nodes 24, 26, the change in the magnetic field causes the three dimensional sensor element to produce an output along the three dimensions of space that correspond to the amount and rate of change of field monitored by the sensor element 30. The waveforms generated along the three axes are determined by the magnetic characteristics of the vehicle sensed.

The sensor nodes 24, 26 can be configured to generate data which corresponds to the direction of a moving vehicle. The system can utilize one or more sensors in order to obtain vehicle direction data. With a single sensor element configuration, as a vehicle approaches the sensor the flux density changes and the sensor output is proportional to the change. The sensor output waveform is substantially a mirror image for the same vehicle moving in the opposite directions.

The configuration of system 10 at a particular installation may depend on, but not limited to, sensor node 24, 26 depth, pair spacing, and positioning distance from the railroad track. These parameters influence the three dimensional waveform data generated by sensor nodes 24, 26. The system 10, once configured, can obtain information pertaining to the passing vehicle such as vehicle speed, direction, length or size of the vehicle. The system 10 can detect, distinguish between and identify vehicles. The sensor element output data from a locomotive engine will be significantly different from a rail car, and type of rail car, such as a box car or tank car will generate detectably different sensor element output data.

Regarding a two or more sensor configuration the sensor nodes 24, 26 are typically placed a relatively small distance from one another. A range of 10-20 meters or alternatively 5-12 meters is suitable. The distance can be user determined based upon a variety of variables including the type and use of the vehicle detection system 10. A suitable sensor node 24, 26 placement can also be about one foot to several meters distance from each other. Further distances between sensors can provide additional advantages, including increased calculation data for analyzing vehicle travel and position. Often a vehicle in motion will create the same signature, merely displaced in time. In one embodiment of the invention, a multisensor configuration 12, 14, 16, 18 generates a multiplicity of sensor nodes 24, 26 data that can be analyzed to produce a multidimensional representation of the magnetic fields at specific locations within and at the limits of the system 10 detection zone. Such analysis enables criteria to be established which correspond to each of the possible on-track vehicle events that can occur within the detection zone of on-track vehicles. The events of interest include on-track vehicles moving in one direction or the other, stopping and reversing direction within the zone, stopping within the zone, speed of movement including speed changes within the zone. Number, placement and configuration of sensor nodes 24, 26 determine the resolution detail of the detection zone representation possible for a particular system 10. The level of resolution required depends upon the accuracy needed to determine specific events within specified timeframes. Ultimately, system 10 layout is a signal engineering design task and is based upon the identified requirements of the specific location where system 10 is to be installed.

The data is analyzed vitally by the system 10 for the purpose of detecting oncoming trains in advance of their travel through grade crossings. The analysis and subsequent decisions and inferences made from vital data processing ensure proper and safe operation of the railroad crossings.

Figure 4:
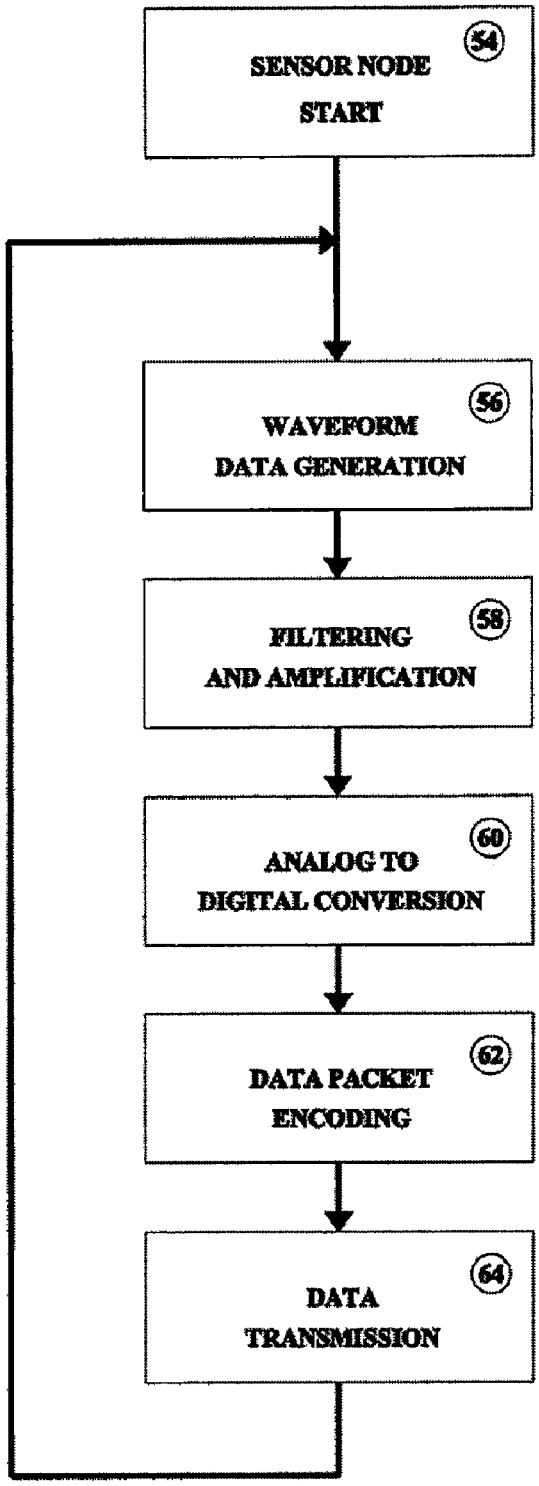
FIG. 4 is a flow chart identifying steps in a method for sensing, processing and transmitting data by the sensor node to the control processor in accordance with at least one embodiment of the present invention.
Figure 5:
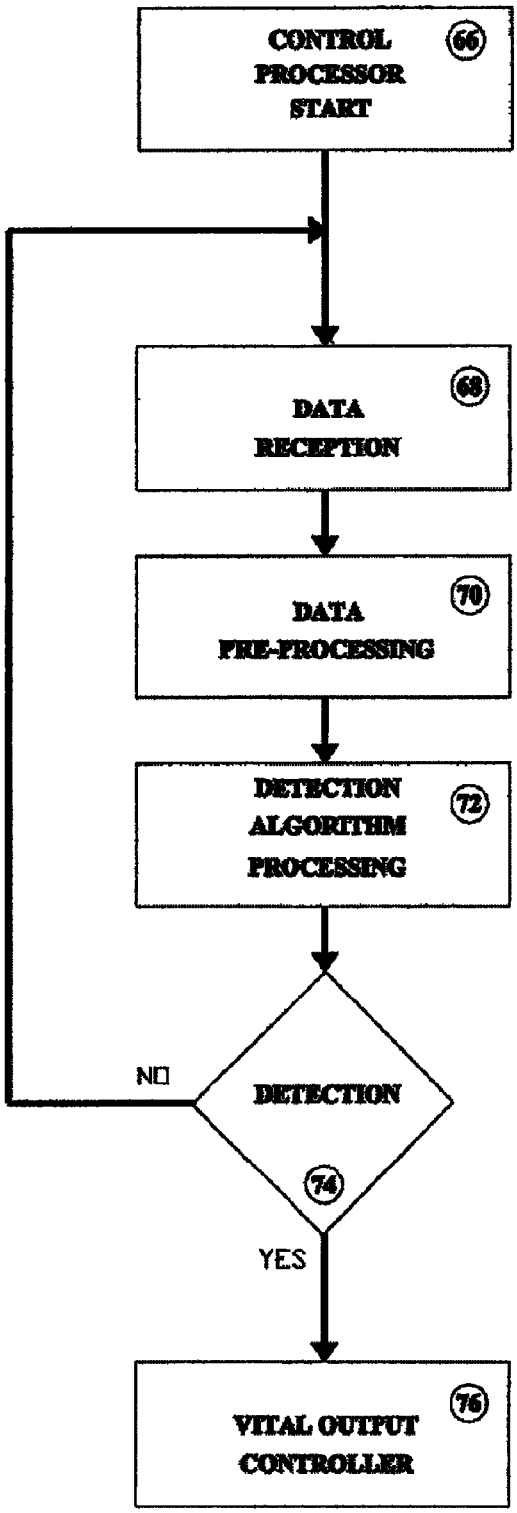
FIG. 5 is a flow chart identifying the steps in a method for processing the data transmitted by the sensor nodes in accordance with at least one embodiment of the present invention.

Now referring to FIGS. 4-5, the system 10 is initialized at step 54. The sensor nodes 24, 26 produce a signal at step 56 whenever any on-track vehicle is within range. The sensor nodes 24, 26 apply the signal to a low pass noise filter and adjust the dynamic range through a low noise instrumentation amplifier at step 58. The resulting waveform is processed by high precision analog to digital converters at step 60. The digitized waveform is organized into fixed length data frames containing sensor ID, packet length, and CRC checksum by a microprocessor at step 62. The data packets are transmitted to the control processor at step 64. The control processor 28 is initialized at step 66 and receives the data at step 68. The processor 28 decodes, and filters data transmitted by the sensor nodes 24, 26 at step 70. Waveform data from all of the sensor nodes 24, 26 is compared and processed by a detection algorithm at step 72, in order to determine classification, speed and direction of the sensed vehicle. In the event that the detected data satisfies, at step 74, criteria requiring warning system activation, the normal output of the vital output controller is de-energized at step 76. The output of the vital output controller is energized if there are no on-track vehicles present and the system reverts back to the ready state after step 66. This is often referred to as the normal state of the system. The de-energized output of the vital output controller 76 corresponds to an alarm state and will result when event criteria for on-track vehicles within the detection zone are satisfied or from internal faults of any element of the system 10.

The warning sequence execution includes the step of removing a normally high output signal from the control interface with the crossing warning device (not shown). As a result, the crossing warning devices for any on-track vehicle approaching or occupying the crossing roadway are activated. On-track vehicles moving away from the crossing roadway or stopped on the approach to the crossing roadway will not typically cause the crossing warning devices to activate. The warning device can be any combination of active railroad crossing signals.

The on-track vehicle must be within the sensing field of a sensor node to be detected. The data received at step 68 from each of the sensor nodes placed for a specific detection zone is processed at step 70 via detection algorithm to determine presence location and speed of an on-track vehicle and the necessary state of the vital output controller 76. The algorithm results that correspond to an on-track vehicle moving toward the crossing zone, where the arrival is predicted within a user specified time, cause the normally energized vital output controller output to be de-energized. If any of the system elements or devices fail to provide data or output that corresponds non-presence of an on-track vehicle or to a stopped on-track vehicle or to an on-track vehicle that is moving away from the crossing zone, the control processor 28 will interrupt the vital output controller 76, causing the crossing signals to activate. This feature maintains a fail safe system and therefore the default position for the system is the warning signal activation, which will occur if any part of the system 10 fails to operate within preset parameters.

Figure 6:
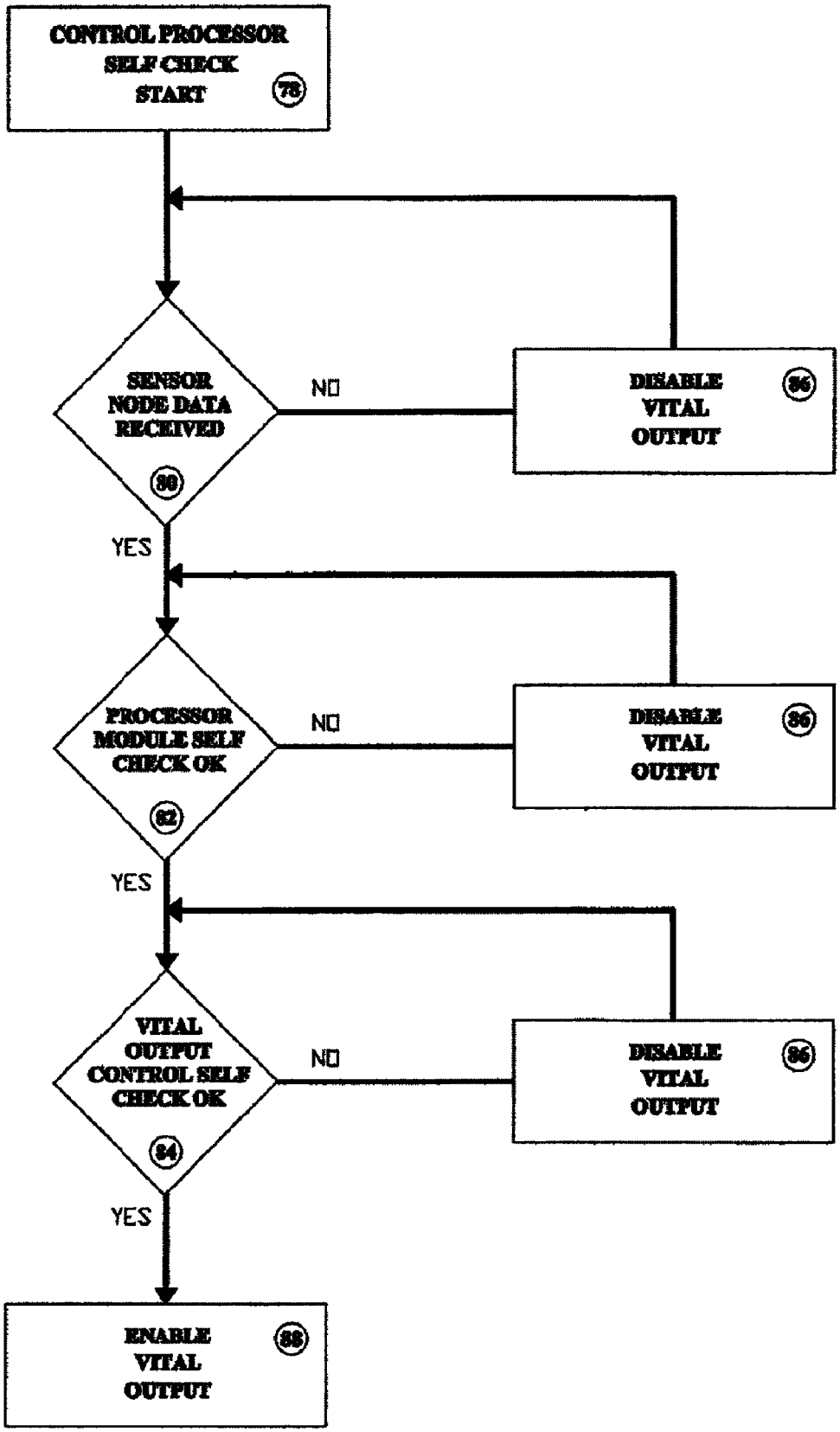
FIG. 6 is a flow chart identifying the steps in a method for the control processor health checks in accordance with at least one embodiment of the present invention.

Referring to FIG. 6, the control processor 28 performs a health check protocol at regular intervals to assure the system is operating properly. The health check protocol is utilized at step 78. Data from each sensor nodes 24, 26 of the system 10 must be received decoded and identified at step 80 by the control processor 28 within a user selected interval range of about 1 to 4 seconds or the output of the vital output controller is disabled at step 86. The processor module is comprised of redundant microprocessors and associated hardware. Each of the processors monitor the heartbeat of the other processors at step 82. All microprocessor heartbeats must agree or the vital output is disabled at step 86. The vital output controller 84 is comprised of redundant microprocessors, associated hardware and relay driver circuits. The microprocessors each monitor the heartbeat of the other processors at step 84. All microprocessor heartbeats must agree or the vital output is disabled at step 86. The microprocessor heartbeat can be the clock signal. If all health check requirements are satisfied and the data processing algorithm result is consistent with no current or pending on-track vehicle occupancy of the grade crossing, the vital output of the control processor is enabled at step 88. Alternatively, the time interval range can be about 2-10 seconds.

In one aspect of the system at least two sensor nodes 24, 26 are positioned in close proximity to one another and strategically placed with respect to the grade crossing and warning device. Transmission of the data from the sensor nodes 24, 26 can be performed through a variety of known technologies. One exemplary manner of transmission includes short-range spread spectrum radio 40. Radio signal transmission is preferably at about 900 MHZ. A secure radio signal transmission link can be provided for increased security.

Waveform data transmitted from the sensor nodes 24, 26 are analyzed through advanced processing techniques. Specific placement of the sensor nodes 24, 26 with respect to the railroad track or roadway affects the waveform detail produced by the sensor node. Sensitivity of the sensor node is determined by inherent characteristics of the physical sensor, the configuration of the resistive bridge element and by the voltage applied.

When the system 10 contains more than one sensor node 24, 26 placed between railroad crossings, it is possible for the sensor devices 12, 14, 16, 18 to function with respect to greater than one grade crossing control device. Since the system 10 is capable of detecting direction of travel, a train traveling in either direction with respect to the sensor nodes 24, 26 can be detected and analyzed.

The information acquired by the sensor nodes 24, 26 can include a variety of information depending upon the type and calibration of the sensor nodes 24, 26. Suitable sensor nodes include the AMR sensors manufactured by Honeywell. Alternatively, one suitable type of sensor node 24, 26 is a 3M Canoga® Model C924TE microloop detector. The 3M Canoga detector detects vehicle presence and movement through an inductive loop.

Additionally, the sensor nodes 24,26 are configured to reduce the incidence of falsing due to environmental, component, or supply voltage variations. Incorrect detection of vehicles is referred to as falsing. The sensor nodes 24, 26 dynamically update the 'bias' value of the sensor element by detecting the proper bias and changing the existing bias value when a user defined threshold results. Through dynamic bias updating the system more accurately maintains the distance between the bias value and the detection threshold value. Without dynamic bias update there is an increased risk that the detection threshold value will result in either false positive or false negative detection.

Variation in environmental temperature can cause falsing to occur. The sensor node 24, 26 is comprised of the sensor element 30, amplifier 32, biasing element 34, microprocessor 36, and analog to digital converter 34. The microprocessor 36 controls the feedback and compensation circuits 38 necessary to maintain the optimum detection condition of the sensor. The biasing, 38 element is typically a negative magnetic flux generating coil that allows minute discrimination of changes in the bias voltage applied to the sensor element 30 by the microprocessor 36. The microprocessor 36 adjusts the voltage to this coil to provide dynamic compensation 36, 38. The sensor element 30 output waveform is amplified 32 and applied to an analog to digital converter 34 and the result is encoded into packets by the microprocessor 36 for transmission by the sensor node radio 40. The automatic bias compensation circuits 36, 38 enable the sensor element 30 to operate in its optimum range when placed into environments where there are extreme variations of temperature, humidity, and flux density.

The various embodiments are given by example and the scope of the invention is not intended to be limited by the examples provided herein. Although the invention has been described in detail with reference to preferred embodiments, variations and modifications exist within the scope and spirit of the invention as described and defined in the following claims.

What is claimed is:

1. A railroad train detection system comprising:

a first multidimensional anisotropic magnetoresistive (AMR) sensor fixed in proximity to a railroad track;

a second multidimensional AMR sensor fixed in proximity to the railroad track and spaced apart from the first AMR sensor;

wherein each AMR sensor is configured to generate multidimensional analog waveform data representative of changes in a generally constant magnetic field environment due to the presence of a railroad train passing on the railroad track;

a signal processor configured to generate multidimensional digital waveform data based on multidimensional analog waveform data generated by the first and second AMR sensors; and a waveform data transmitter configured to transmit multidimensional digital waveform data from the signal processor to a system processing apparatus, wherein the system processing apparatus is configured to control an active warning device at a railroad track crossing using the transmitted digital waveform data;

wherein the signal processor comprises:

a filter and amplifier configured to convert multidimensional analog waveform data to processed multidimensional analog waveform data;

an analog-to-digital converter configured to convert processed multidimensional analog waveform data to multidimensional digital waveform data; and an encoder configured to encode multidimensional digital waveform data to generate encoded multidimensional digital waveform data;

further wherein waveform data transmitter transmission of multidimensional digital waveform data comprises transmission of encoded multidimensional digital waveform data; and further wherein the waveform data transmitter is further configured to transmit using spread spectrum radio transmission.

2. The railroad train detection system of claim 1 wherein the signal processor comprises a bias compensator configured to compensate for changes in the first and second AMR sensors due to at least one of the following:

environmental variations; flux density variations; humidity variations; temperature variations; component variations; supply voltage variations.

3. The railroad train detection system of claim 1 further comprising a third AMR sensor and a fourth AMR sensor, the first, second, third and fourth AMR sensors defining a detection zone on the railroad track and further defining a crossing zone within the detection zone, wherein the crossing zone comprises the railroad track crossing.

4. The railroad train detection system of claim 1 wherein the system processing apparatus comprises a failsafe processor apparatus configured to cause operation of the active warning device in a safest condition should any element of the system processing apparatus fail, wherein the failsafe processor apparatus is a closed circuit design.

5. The railroad train detection system of claim 1 wherein multidimensional analog waveform data comprises output along three dimensions of space that correspond to the amount and rate of change of magnetic field monitored by each AMR sensor.

6. The railroad train detection system of claim 1 wherein the system processing apparatus activates the active warning device by removing a normally high output signal at a control interface between the system processing apparatus and the active warning device.

7. A railroad train detection system comprising:

a first multidimensional anisotropic magnetoresistive (AMR) sensor fixed in proximity to a railroad track;

a second multidimensional AMR sensor fixed in proximity to the railroad track and spaced apart from the first AMR sensor;

wherein each AMR sensor is configured to generate multidimensional analog waveform data representative of changes in a generally constant magnetic field environment due to the resence of a railroad train a passing on the railroad track;

a signal processor configured to generate multidimensional digital waveform data based on multidimensional analog waveform data generated by the first and second AMR sensors; and a waveform data transmitter configured to transmit multidimensional digital waveform data from the signal processor to a system processing apparatus, wherein the system processing apparatus is configured to control an active warning device at a railroad track crossing using the transmitted digital waveform data;

wherein the system processing apparatus comprises at least one of the following:

a vital processing module comprising a plurality of microprocessors coupled to provide vital processing of active warning device control data;

a communications module configured to provide communications between the system processing apparatus and the first and second AMR sensors via the waveform data transmitter, and between the system processing apparatus and the active warning device;

a vital I/O module configured to provide vital I/O control of at least one of the following:

one or more railroad signal relays;

one or more control devices;

a diagnostic testing and logging module configured to provide user access to the system processing apparatus to permit one or more of the following: entry of site specific information, selection or entry of user variable values, performing set-up or other processes, diagnostic testing and to review, download or upload data log files;

a user interface module;

a remote operations module configured to provide remote communications with the railroad train detection system via cellular or satellite communication to perform at least one of the following:

remote status checking;

alarm notification;

configuration control;

data transfer.

8. The railroad train detection system of claim 7 wherein the signal processor comprises a bias compensator configured to compensate for changes in the first and second AMR sensors due to at least one of the following:

environmental variations; flux density variations; humidity variations; temperature variations; component variations; supply voltage variations.

9. The railroad train detection system of claim 7 wherein the signal processor comprises:

a filter and amplifier configured to convert multidimensional analog waveform data to processed multidimensional analog waveform data;

an analog-to-digital converter configured to convert processed multidimensional analog waveform data to multidimensional digital waveform data; and an encoder configured to encode multidimensional digital waveform data to generate encoded multidimensional digital waveform data;

further wherein waveform data transmitter transmission of multidimensional digital waveform data comprises transmission of encoded multidimensional digital waveform data; and further wherein the waveform data transmitter is further configured to transmit using spread spectrum radio transmission.

10. The railroad train detection system of claim 9 wherein the signal processor further comprises a bias compensator configured to compensate for changes in the first and second AMR sensors due to at least one of the following:

environmental variations; flux density variations; humidity variations; temperature variations; component variations; supply voltage variations.

11. The railroad train detection system of claim 10 wherein the system processing apparatus comprises a failsafe processor apparatus configured to cause operation of the active warning device in a safest condition should any element of the system processing apparatus fail, wherein the failsafe processor apparatus is a closed circuit design.

12. The railroad train detection system of claim 11 wherein multidimensional analog waveform data comprises output along three dimensions of space that correspond to the amount and rate of change of magnetic field monitored by each AMR sensor.

13. The railroad train detection system of claim 12 wherein the system processing apparatus activates the active warning device by removing a normally high output signal at a control interface between the system processing apparatus and the active warning device.

14. The railroad train detection system of claim 13 wherein the system processing apparatus comprises a plurality of redundant microprocessors, wherein each microprocessor monitors heartbeats from any other microprocessor in the system processing apparatus and further wherein the active warning device is activated if any heartbeats do not agree.

15. The railroad train detection system of claim 14 wherein encoded multidimensional digital waveform data received by the system processing apparatus is used to determine at least one of the following:

the presence of a train that is stationary on the railroad track; train speed; train direction of movement; train length; train size; train identification; type of rail car in a given train; train position on the railroad track; stopping of a train on the railroad track; reversal of direction of a train on the railroad track.

16. A railroad train detection system comprising:

a plurality of multidimensional anisotropic magnetoresistive (AMR) sensors fixed in proximity to a railroad track, wherein the plurality of multi-dimensional AMR sensors define a train detection zone on the railroad track;

wherein each AMR sensor is configured to generate multidimensional analog waveform data representative of changes in the Earth's generally constant magnetic field due to the presence of one or more nearby railroad train cars in the detection zone;

a signal processor configured to generate multidimensional digital waveform data based on multidimensional analog waveform data generated by the plurality of AMR sensors;

a waveform data transmitter configured to transmit multidimensional digital waveform data from the signal processor to a system processing apparatus; and the system processing apparatus configured to receive, process and compare waveform data from the plurality of AMR sensors, wherein the system processing apparatus is further configured to determine at least one of the following:

speed of a train in the detection zone;

direction of movement of a train in the detection zone;

length of a train in the detection zone;

size of a train in the detection zone;

stopping and reversing direction by a train in the detection zone;

stopping of a train in the detection zone;

changes in speed of a train in the detection zone;

decoupling of one or more train cars by a train in the detection zone;

multidimensional representation of magnetic fields in the detection zone.

17. The railroad train detection system of claim 16 wherein the plurality of AMR sensors are spaced apart by a spacing of at least 10 meters.

18. The railroad train detection system of claim 17 wherein the waveform data transmitter is a wireless transmitter using radio signals.

19. The railroad train detection system of claim 17 further comprising one or more bias compensators configured to maintain approximately optimum bias for each of the plurality of AMR sensors.

20. The railroad train detection system of claim 16 further comprising a vital processing module, the vital processing module comprising two redundant microprocessors and redundant relay driver circuits, wherein the redundant microprocessors are configured to perform health checks of each other using heartbeat signals.

21. A railroad train detection system comprising:

a plurality of sensor devices fixed in proximity to a railroad track, wherein each sensor device comprises one or more multidimensional anisotropic magnetoresistive (AMR) sensors, further wherein the plurality of sensor devices define a train detection zone on the railroad track;

wherein each AMR sensor is configured to generate multidimensional analog waveform data representative of changes in the Earth's generally constant magnetic field due to the presence of one or more nearby railroad train cars in the detection zone;

at least one signal processor configured to generate multidimensional digital waveform data based on multidimensional analog waveform data generated by one or more of the AMR sensors;

a waveform data transmitter configured to transmit multidimensional digital waveform data from the signal processor to a system processing apparatus; and the system processing apparatus configured to receive, process and compare waveform data from the plurality of AMR sensors, wherein the system processing apparatus is further configured to determine at least one of the following:

speed of a train in the detection zone;

direction of movement of a train in the detection zone;

length of a train in the detection zone;

size of a train in the detection zone;

stopping and reversing direction by a train in the detection zone;

stopping of a train in the detection zone;

changes in speed of a train in the detection zone;

decoupling of one or more train cars by a train in the detection zone;

multidimensional representation of magnetic fields in the detection zone.

* * * * *